US011844440B2

(12) United States Patent
Schüller et al.

(10) Patent No.: US 11,844,440 B2
(45) Date of Patent: Dec. 19, 2023

(54) CHAIR

(71) Applicant: AETERON GMBH, Vaihingen an der Enz (DE)

(72) Inventors: Hans Schüller, Vaihingen/Enz (DE); Flaviu Bragoi, Ludwigsburg (DE); Daniel Drotleff, Remseck (DE)

( * ) Notice: Subject to any disclaimer, the term of this patent is extended or adjusted under 35 U.S.C. 154(b) by 0 days.

(21) Appl. No.: 17/800,987

(22) PCT Filed: Feb. 22, 2021

(86) PCT No.: PCT/EP2021/054279
§ 371 (c)(1),
(2) Date: Dec. 28, 2022

(87) PCT Pub. No.: WO2021/165522
PCT Pub. Date: Aug. 26, 2021

(65) Prior Publication Data

US 2023/0210264 A1 Jul. 6, 2023

(30) Foreign Application Priority Data

Feb. 21, 2020 (DE) ..... 20158890.2

(51) Int. Cl.
*A47C 3/021* (2006.01)
*A47C 7/02* (2006.01)
(Continued)

(52) U.S. Cl.
CPC ..... *A47C 7/14* (2013.01); *A47C 3/021* (2013.01); *A47C 7/402* (2013.01); *A47C 7/46* (2013.01); *A61G 5/1064* (2013.01)

(58) Field of Classification Search
CPC ..... A47C 3/021; A47C 7/14; A47C 1/023; A47C 7/46; A61G 5/1064
(Continued)

(56) References Cited

U.S. PATENT DOCUMENTS 465,275 A * 12/1891 Kenney et al. ..... A47C 3/0255 297/277
648,740 A * 5/1900 Haggard et al. ..... A47C 1/035 297/70
(Continued)

FOREIGN PATENT DOCUMENTS

AT 522122 A1 * 8/2020 ..... A47C 7/14
CA 2838200 A1 6/2015
(Continued)

OTHER PUBLICATIONS

The International Search Report (with English translation) and the Written Opinion (with English translation) of the International Searching Authority, or the Declaration for International Application No. PCT/EP2021/054279, dated May 27, 2021.

*Primary Examiner* — Rodney B White
(74) *Attorney, Agent, or Firm* — Brett A. Schenck

(57) ABSTRACT

A chair having a chair base (1), a seat part (5, 6, 7, 8) connected thereto, a backrest (9, 16, 17) connected thereto, the seat 5 part (5, 6, 7, 8) pivotable about at least one horizontal or inclined horizontal axis and the backrest (9, 16, 17) are spatially adjustable. The seat part (5, 6, 7, 8) has at least three seat elements (5, 6, 7) that can be adjusted in relation to one another and whose operating positions can be adjusted individually.

8 Claims, 10 Drawing Sheets

(51) Int. Cl.

| | |
|---|---|
| ***A47C 7/14*** | (2006.01) |
| ***A47C 7/46*** | (2006.01) |
| ***A61G 5/10*** | (2006.01) |
| ***A61G 5/14*** | (2006.01) |
| ***A47C 7/40*** | (2006.01) |

(58) Field of Classification Search
USPC ..... 297/284.3, 284.11, 286, 287, 312
See application file for complete search history.

(56) References Cited

U.S. PATENT DOCUMENTS 1,836,630 A * 12/1931 Thum ..... A47C 7/441 297/312
2,532,025 A * 11/1950 Johnson ..... A47C 3/021 297/286
2,535,138 A * 12/1950 Johnson ..... A47C 3/0252 297/286
2,541,938 A * 2/1951 Rideout ..... A47C 1/035 297/287
2,586,951 A * 2/1952 Johnson ..... A47C 3/0252 297/286
2,617,471 A * 11/1952 Lorenz ..... A47C 1/035 297/321
3,112,137 A * 11/1963 Drenth ..... A47C 31/126 297/284.3
3,446,532 A * 5/1969 Cramer ..... A47C 3/026 297/312
3,565,482 A * 2/1971 Blodee ..... A47C 7/14 297/284.3
3,712,666 A * 1/1973 Stoll ..... A47C 1/0244 297/313
3,877,750 A * 4/1975 Scholpp ..... A47C 1/143 297/284.3
3,990,742 A * 11/1976 Glass ..... A47C 7/029 297/284.3
4,498,702 A * 2/1985 Raftery ..... A47C 7/14 297/312 X
4,585,272 A * 4/1986 Ballarini ..... A47C 3/12 297/285
4,621,866 A * 11/1986 Zani ..... A47C 7/46 297/284.3 X
4,861,106 A * 8/1989 Sondergeld ..... A47C 1/03294 297/316
4,893,827 A * 1/1990 Gay ..... A61G 5/125 297/411.39
5,005,905 A * 4/1991 Sondergedl ..... A47C 1/03294 297/320
5,009,466 A * 4/1991 Perry ..... A47C 1/03294 297/300.1
5,108,148 A * 4/1992 Henke ..... A47C 1/035 297/321
5,228,747 A * 7/1993 Greene ..... A61G 5/00 297/284.3
RE34,354 E * 8/1993 Sondergeld ..... A47C 1/03238 297/320
5,380,063 A * 1/1995 Dauphin ..... A47C 1/023 297/284.11
5,401,077 A 3/1995 Hosoe
5,597,203 A * 1/1997 Hubbard ..... A47C 7/024 297/284.3 X
5,716,099 A * 2/1998 McDiarmid ..... A47C 7/024 297/284.11
5,975,641 A * 11/1999 Delesie ..... A47C 23/062 297/284.3
5,984,409 A * 11/1999 Eakin ..... A47C 3/0255 297/282
6,106,063 A * 8/2000 Dauphin ..... A47C 1/023 297/284.11
6,189,971 B1 * 2/2001 Witzig ..... A47C 1/023 297/284.11
6,499,802 B2 * 12/2002 Drira ..... A47C 7/024 297/284.11
6,863,346 B2 * 3/2005 Zund ..... A47C 7/14 297/321
6,890,030 B2 * 5/2005 Wilkerson ..... A47C 1/023 297/284.11 X
7,270,378 B2 * 9/2007 Wilkerson ..... A47C 7/14 297/452.56
7,350,863 B2 * 4/2008 Engels ..... A47C 7/40 297/284.3
7,484,803 B2 * 2/2009 Dozsa-Farkas .... A47C 1/03283 297/320
7,648,201 B2 * 1/2010 Eysing ..... A47C 7/46 297/284.3
7,784,871 B2 * 8/2010 Cochran ..... A47C 9/005 297/284.3
7,905,549 B2 * 3/2011 Lake ..... A47D 1/004 297/344.22
7,922,248 B2 * 4/2011 Aldrich ..... A47C 1/023 297/316
8,262,162 B2 * 9/2012 Castro, Jr. ..... A47C 7/027 297/285
8,419,133 B2 * 4/2013 Holt ..... A47C 1/03266 297/284.3
8,534,759 B2 * 9/2013 De La Garza ..... B64D 11/064 297/411.31
8,801,638 B2 * 8/2014 Gierse ..... A61G 7/1096 297/312 X
8,939,507 B2 * 1/2015 Thomaschewski .... B60N 2/643 297/284.3
8,944,507 B2 * 2/2015 Goetz ..... A47C 9/005 297/321
10,973,326 B2 * 4/2021 Ehrenleitner ..... A47C 7/14
11,596,232 B2 * 3/2023 Goetz ..... A47C 7/46
2004/0195882 A1 * 10/2004 White ..... A47C 4/028 297/284.3
2004/0256899 A1 * 12/2004 Moore ..... A61G 5/1067 297/284.3
2006/0103221 A1 5/2006 Kleist
2006/0255635 A1 * 11/2006 Iijima ..... B60N 2/865 297/284.3
2009/0236887 A1 * 9/2009 Lu ..... A47C 7/405 297/284.3
2011/0101748 A1 5/2011 Goetz
2013/0127219 A1 * 5/2013 Gerwig ..... A47C 1/03255 297/284.3
2014/0132051 A1 * 5/2014 Freedman ..... A47C 7/02 297/312
2014/0159450 A1 * 6/2014 Guering ..... B64D 11/06 297/284.3
2014/0167464 A1 * 6/2014 Kordyl ..... A47C 31/126 297/284.3
2015/0182027 A1 7/2015 Chang et al.
2018/0339623 A1 11/2018 Reinhard
2019/0082848 A1 3/2019 McClintock
2019/0125609 A1 5/2019 Mason et al.
2020/0352337 A1 * 11/2020 van der Heyden .... A47C 7/446

FOREIGN PATENT DOCUMENTS

CH 692969 A5 * 1/2003 ..... A47C 1/023
DE 2837558 A1 3/1980
DE 69200320 T2 12/1994
DE 4429636 C1 7/1995
DE 102007042032 B3 * 2/2009 ..... A47C 7/024
EP 3367845 B1 8/2019
KR 20160096253 A 8/2016
KR 1674489 B1 * 11/2016 ..... A47C 7/022
KR 2020046600 A * 5/2020 ..... A47C 1/023
WO WO-9317604 A1 * 9/1993 ..... A47C 7/022
WO WO9622715 A1 8/1996
WO WO-2011135462 A2 * 11/2011 ..... A47C 7/024
WO WO-2019073467 A1 * 4/2019 ..... A47C 1/023

* cited by examiner

CHAIR

CROSS REFERENCE TO RELATED APPLICATIONS

The present Application is a national stage of International Patent Application No. PCT/EP2021/054279, titled "Chair", filed Feb. 22, 2021, which claims priority to German application no. DE 20158890.2 filed on Feb. 21, 2020, the contents of which are incorporated by reference.

FIELD

The invention relates to a chair according to the preamble of claim 1.

Usual chairs, especially office chairs, often have a number of adjustment options such as height adjustment of the seat and the backrest or a tilt adjustment of the backrest. More comfortable models also have a limited inclination adjustment of the seat to enable an optimal adjustment for the pelvis. Additional comfort options often include armrests, which may be height-adjustable, and a headrest, which may also be adjustable. Other individual adjustment options for the seat, the backrest and the armrests are not known.

BACKGROUND

DE 2 837 558 A1 discloses a work chair whose seat and backrest are height adjustable. Furthermore, the seat can be pivoted together with the backrest about a common horizontal axis and can be rotated relative to a chair base, the backrest also being able to be pivoted independently of the seat. If the seat is tilted forwards too much, the user may undesirably slide forward and there is no support for the thighs because the seat is too short for this.

DE 692 00 320 T2 describes a chair whose seat, together with the backrest and armrests, can be adjusted in height relative to a chair base. The backrest and armrests can also be adjusted together in height compared to the seat. Furthermore, the seat is divided into a rear part and a connected front part supporting the legs, the front part being pivotable downwards depending on a height adjustment of the seat in order to allow the knees to be lowered in relation to the hips. It is not possible to pivot the front part independently of the height adjustment.

EP 3 367 845 B1 describes a backrest which, along a columnar support which extends upwards from the middle of the rear end of the chair seat, has a number of U-shaped transverse straps arranged on both sides of the support to support the back muscles of a person on the Has seated user chair. The transverse straps leave the area of the spine free, with the front sides of the column-like support and the transverse straps adapting to the shape of the spine and back, and the counter-pressure of the front sides being adjustable.

From KR 2016 096 253 A, a chair is known, the seat of which is connected to the backrest at its rear end, the seat being pivotable about a horizontal axis and the backrest also being pivotable independently of this. Furthermore, the backrest consists of mutually articulated segments, the surfaces of which can be tilted independently in their vertical alignment in order to allow an adjustment to the back of the user.

The object of the invention is to provide a chair that can be ergonomically adjusted to the seated position of the user and at the same time enables a stable and relaxed seated position.

SUMMARY

This object is solved by the features of claim 1.

These are:

Chair, having a chair base, a seat part connected thereto, a backrest connected thereto, wherein the seat part can be pivoted about at least one horizontal or inclined horizontal axis and the seat part has a seat surface, in particular for the buttocks area, (and preferably at least two or three independently adjustable seat elements, in particular for the thigh area of a person sitting on the chair, the operating positions of which can be adjusted individually) and wherein the horizontal pivot axis of the seat part, which preferably extends parallel to a surface of the backrest, is arranged approximately centrally above the seat surface of the seat part. As a result, the horizontal pivot axis is preferably approximately coaxial to a hip joint axis of the properly seated person.

Provision is preferably made for the seat part to be suspended from a (fork-shaped) seat arm and/or to be movably mounted on this seat arm such that it can pivot about the horizontal pivot axis of the seat part 5, 6, 7, 8. The seat arm preferably encloses the seat surface of the seat part at least partially laterally with its ends forming/carrying pivot axes (pivot joint).

The enclosure may extend at least to the pivot point approximately midway above the seat bottom. The seat can be suspended in a swing-like manner due to the central arrangement above the seat, which can be conducive to a particularly back-friendly sitting position.

The seat part preferably has at least two or three seat elements that can be adjusted independently of one another and preferably whose operating positions can be set individually. The chair according to the invention has the advantage over the prior art that the independent adjustment possibility of the seat elements enables the seat part to be adjusted in a way that supports the user and prevents posture problems.

Further improvements emerge from the features of the subclaims. In a first advantageous embodiment, either the seat part and the backrest can be pivoted and locked about at least a first common horizontal or inclined horizontal axis, or the seat part can be pivoted about at least a first and the backrest about at least a second horizontal or inclined horizontal axis, which are swiveling and lockable independent of one another.

The seat part/seat shell is particularly preferably freely pivotable about a pivot axis located above the seat part, preferably transversely to a seat direction. The pivot axis is preferably at the same level as the joint between the femur and hip of a person sitting on the chair. The pivot axis is particularly preferably located in front of the backrest or is spaced horizontally from it. As a result, the pivot axis is arranged approximately next to the joint between the thigh bone and the hip of a person sitting on the chair. The free pivoting can preferably be locked in any position.

The joint can be arranged on the chair base and connect the seat part to it. The seat part can thus be (freely) pivotable about two axes, the axes preferably being arranged approximately orthogonally to one another.

The backrest can preferably be tilted sideways (laterally) and/or forwards/backwards (frontal) with the seat part, but it can also be deformable in itself. This deformability can manifest itself in particular in a change in the inclination of individual vertebral modules to one another, which can cause a frontal, lateral, but also a mixed inclination of these two.

In a second advantageous embodiment, either the seat part and the backrest are pivotable and lockable about a second common horizontal or inclined horizontal axis, which is arranged perpendicular to the first common horizontal or inclined horizontal axis, or the seat part about a third and the backrest about at least one fourth horizontal or inclined horizontal axis pivoting and lockable, arranged independently of each other and perpendicular to the second and third independent horizontal or inclined horizontal axes.

In a third advantageous embodiment, the seat part has a seat shell with seat leg depressions, a seat cushion, a saddle curvature and leg supports, with the seat cushion being arranged in the seat shell. The saddle arch and the leg supports are connected to the seat shell, the saddle arch and the leg supports being pivotable and lockable about a common horizontal or inclined horizontal axis, and the saddle arch and the leg supports being independently pivotable and lockable.

In a fourth advantageous embodiment, the seat part is connected to the chair base by means of a base arm connected to the chair base at, at least a first end thereof, a recliner module connected at least a first end thereof to a further end or portion of the base arm, and one to a first End or a portion connected to another end or a portion of the tilt module associated seat arm. At least one further end of the seat arm can be connected to at least a first end of a back arm, with the at least first end of the back arm preferably being connected to at least a first end of the seat shell and a further end or a section of the back arm being connected to one end of the backrest and a sacrum support (lumbar support) is connected.

In a fifth advantageous embodiment, the base arm is pivotable and lockable relative to the chair base about a horizontal and<or inclined horizontal axis, wherein the inclination module can be pivoted and lockable relative to the base arm about a horizontal or inclined horizontal axis.

The seat arm may be pivotable and lockable relative to the reclining module about a horizontal or inclined horizontal axis, which is preferably perpendicular to the axis between the base arm and the reclining module. In addition, the back arm can be pivotable and lockable relative to the seat arm and seat shell independently of one another, or the seat shell relative to the seat arm and back arm can be pivotable and lockable independently of one another about a horizontal or inclined horizontal axis.

In a sixth advantageous embodiment, the seat part with the backrest is rotatable relative to the chair base, adjustable in height and lockable, the backrest being height-adjustable and lockable relative to the seat part.

In a seventh advantageous embodiment, the backrest can be pivoted and locked about at least one vertical or inclined vertical axis.

In an eighth advantageous embodiment, the chair, in particular its backrest, has individual vertebral modules connected to one another and preferably back slats connected to these. The vertebral modules can have adjusting means, which are adjustable and can interact with adjacent modules in the operating state of the chair in a movement-limiting manner, as a result of which the inclination of the modules relative to one another can be limited and set. This adjustability is preferably made possible in several spatial directions, in particular laterally and frontally, but advantageously also laterally. Consequently, angles of inclination between two modules relative to individual directions of inclination can preferably be adjusted individually.

The inclination can be changed, for example, via a ball and socket joint connection between two adjacent modules. A single adjusting means can be provided in particular as a pin or other limiting means, which limits the inclination of the modules to one another in one or more spatial directions, for example by blocking the movement.

The further the positioning means is advanced from one module in the direction of the second, the smaller the distance between the second module and the positioning means and consequently the possible angle of inclination of the second module to the first is also smaller.

The vertebral modules can therefore allow the backrest to be inclined freely and steplessly in any spatial direction, which means that the backrest can also perform a complex movement, such as to the side, from there to the back, in the rear position to the other side and from there to the front again, i.e. in for example a circular or elliptical movement. This can be beneficial for a particularly back-friendly support from the backrest.

In a ninth advantageous embodiment, the chair has armrests that are spatially adjustable.

In a tenth advantageous embodiment, the armrests are height-adjustable relative to the seat part and/or pivotable and lockable about two vertical or inclined vertical axes and/or about a horizontal or inclined horizontal axis.

In an eleventh advantageous embodiment, the armrests have a common main arm and/or an armrest and/or a holder and/or a height adjustment and/or a rotating arm, wherein the armrest can be mounted on a first end of the holder. In this case, the holder is mounted with a second end on the height adjustment, it being possible for the height adjustment to be mounted on a first end of the rotary arm. In addition, a second end of the pivot arm may be journaled to a first or second end of the main arm, and a portion of the main arm may be connected to a vertebral module.

In a twelfth advantageous embodiment, the armrest can be pivoted and/or fixed relative to the mount about a vertical and/or inclined vertical axis, the mount being displaceable and/or fixable along a vertical and/or inclined vertical guide of the height adjustment. The height adjustment can be pivotable and lockable relative to the rotary arm about a horizontal and/or inclined horizontal axis, with a second end of the rotary arm being pivotable and/or lockable relative to the main arm about a perpendicular or inclined vertical axis.

In a thirteenth advantageous embodiment, the chair has a headrest that is spatially adjustable.

In a fourteenth advantageous embodiment, the headrest has a first end connected to a further end of the backrest and/or a head holder connected to a further end of the final vertebra. The head mount can be displaceable along a vertical or inclined vertical guide of the terminal vertebra and/or pivotable and lockable about a horizontal or inclined horizontal axis perpendicular to the guide.

In a fifteenth advantageous embodiment, the seat part and/or the backrest are mounted so that they can move freely.

In a sixteenth advantageous embodiment, the chair base is mounted on castors.

In a seventeenth advantageous embodiment, the base arm is additionally connected to the tilting module by means of a gear chain. The transmission chain runs around the horizontal or inclined horizontal axes between the chair base and the base arm and between the base arm and the incline module. As a result, the base arm and the tilt module can be swiveled at the same time.

In an eighteenth advantageous embodiment, the chair base with the base arm and/or the seat arm with the back arm are each additionally connected by means of a damping mechanism, such as a damping mechanism e.g. connected to a gas spring.

In a nineteenth advantageous embodiment, the vertebral modules are connected to one another in an articulated and/or spring-loaded manner so that they can be adjusted in relation to one another, the back lamellae being connected to the vertebral modules by means of a damping mechanism, such as e.g. springs or elastic materials can be connected.

In a twentieth advantageous embodiment, the seat cushion and the back slats have elastic materials, such as rubber or foam.

In a twenty-first advantageous embodiment, the seat cushion has a section which overlaps with the ischial depression and whose material properties are adapted to the ischial depression.

Individual embodiments and individual features of embodiments can be combined in any way.

BRIEF DESCRIPTION OF THE DRAWINGS

The invention will now be explained in more detail using an exemplary embodiment. Show it.

DETAIL DESCRIPTION

FIGS. 1 to 8 show an embodiment of the chair according to the invention with all the essential features.

Figure 1:
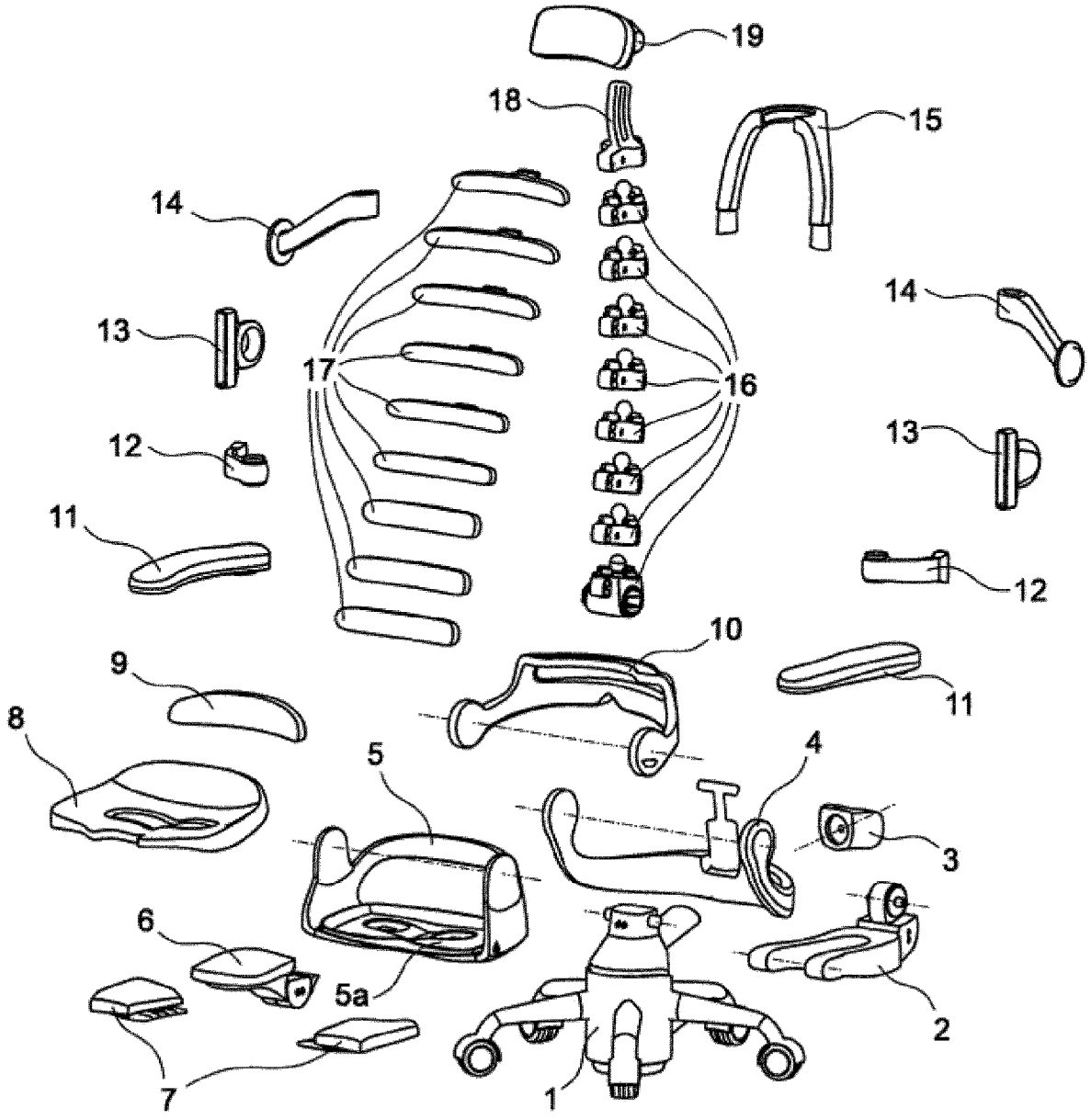
FIG. 1 is an exploded front perspective view of an embodiment of the chair of the present invention.
Figure 2:
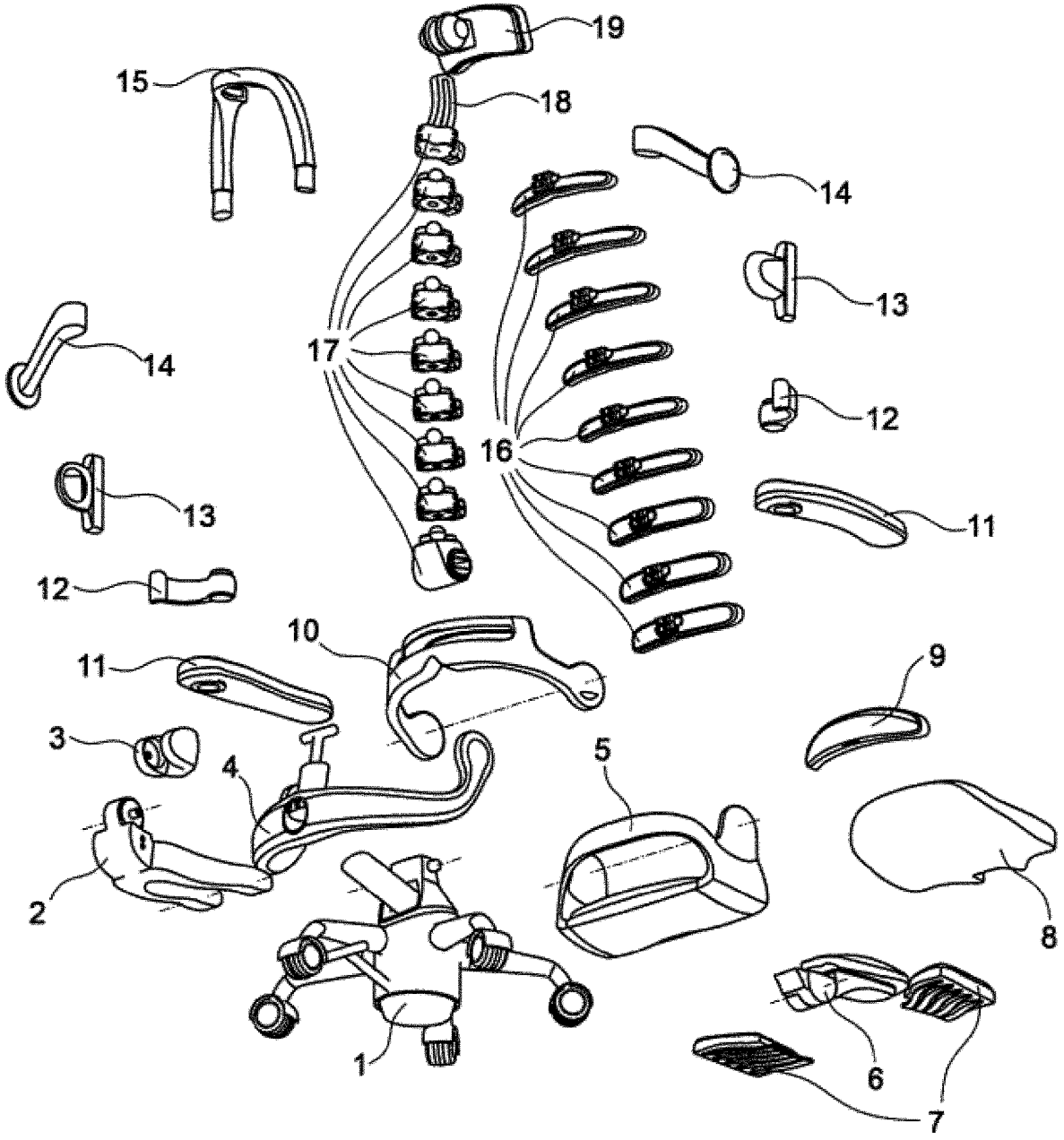
FIG. 2 is an exploded rear perspective view of the embodiment of FIG. 1.

FIGS. 1 and 2 show the embodiment in exploded front and rear perspective views. The embodiment can have components that are designated as follows: 1 chair base, 2 base arm, 2*a* transmission chain (FIG. 7), 3 inclination module (lateral), 4 seat arm, 5 seat shell, 5*a* seat leg recess, 6 seat arch, 7 leg support, 8 seat cushion.

Figure 3:
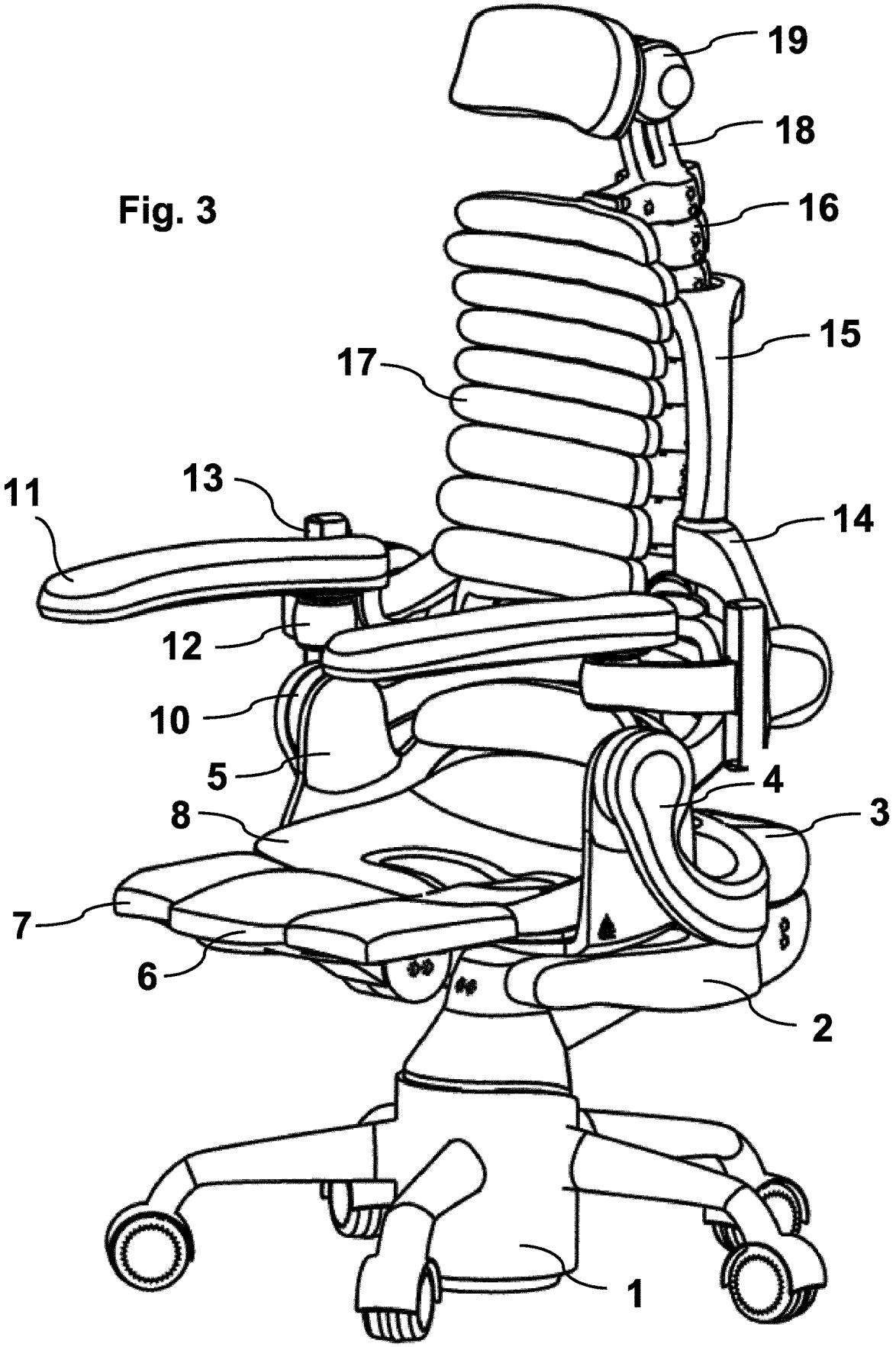
FIG. 3 is a front perspective view of the embodiment of FIG. 1.
Figure 4:
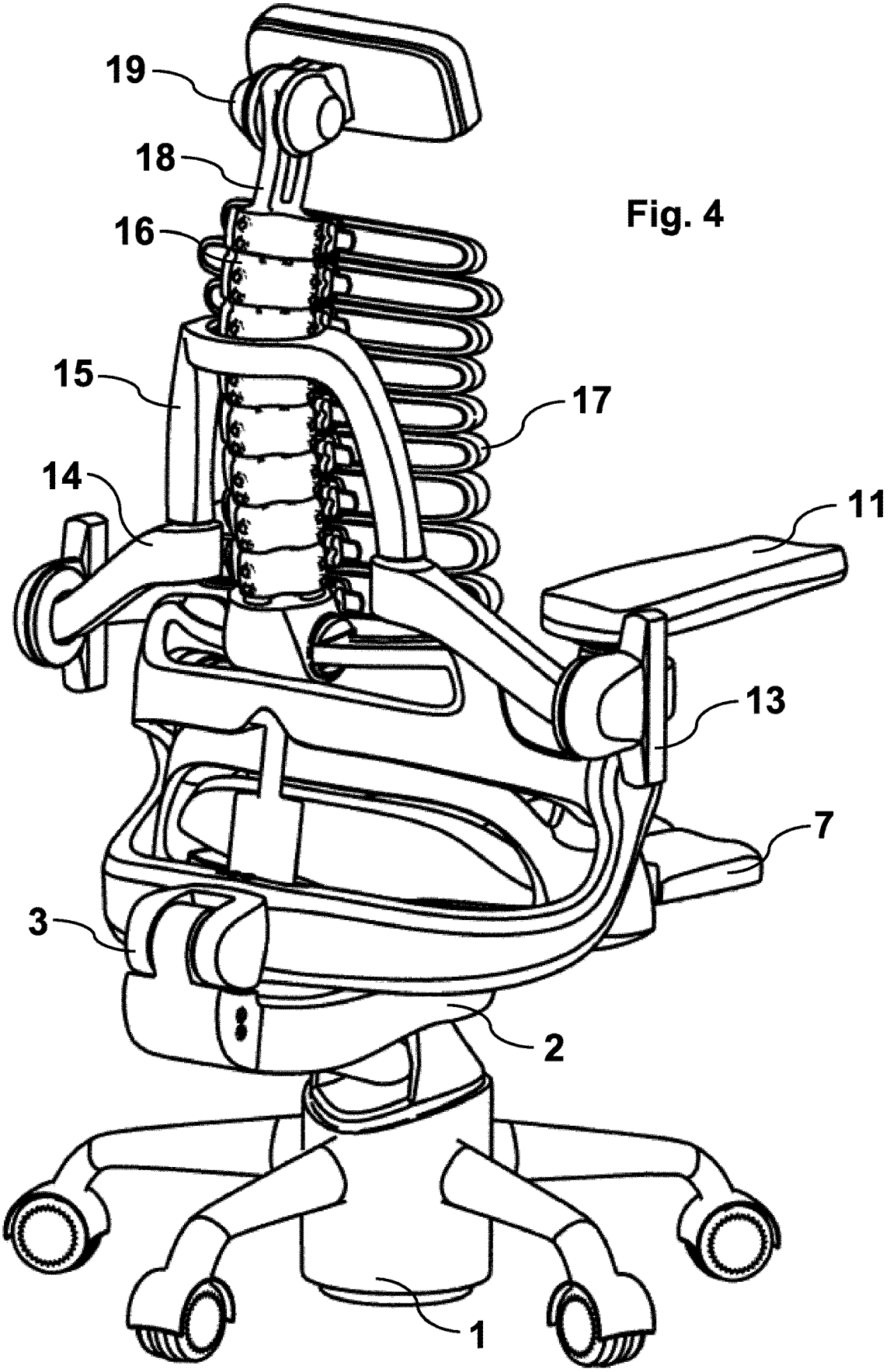
FIG. 4 shows a perspective rear view of the embodiment according to FIG. 1.

FIGS. 3 and 4 show the embodiment in a perspective front and rear view in a first operating position. The essential components of the chair can be: a chair base 1, a seat part 5, 6, 7, 8 connected thereto, a backrest 9, 16, 17 connected thereto, the seat part 5, 6, 7, 8 being at least one horizontal or inclined horizontal axis pivotable and the backrest 9, 16, 17 is spatially adjustable. The seat part 5, 6, 7, 8 has at least three independently adjustable seat elements whose operating positions can be adjusted individually. The independent adjustment possibility of the seat elements enables the seat part 5, 6, 7, 8 to be adjusted in a way that supports the user and prevents postural problems.

In principle, the seat part 5, 6, 7, 8 and the backrest 9, 16, 17 can be pivoted and locked about at least one first common horizontal and/or inclined horizontal axis and/or the seat part 5, 6, 7, 8 about at least one the first and the backrest 9, 16, 17 being pivotable and lockable about at least a second horizontal or inclined horizontal axis which are independent of each other. This makes it possible to tilt either the backrest 9, 16, 17 together with the seat part 5, 6, 7, 8 or the backrest 9, 16, 17 and the seat part 5, 6, 7, 8 independently of one another forwards or backwards. The tilting or swiveling movements can in particular take place freely and/or with little resistance, which means that an independent adjustment for a back-friendly posture can be achieved with regard to the lateral inclination and/or the frontal tilting or swiveling movement.

The correct inclination of the seat part is thereby caused by the natural shape of the user's spine and consequently the position of the hips. This can be positively reinforced by the lumbar supports.

The free adjustability of the two above-mentioned angles (frontal, lateral) can be a first essential requirement for a freely adjustable setting that can be changed during operation and enable the user's pelvis and back to be held gently during a seated activity. Based on the latest studies, it is known that changing the sitting position several times during working hours is a necessary prerequisite for fatigue-free and tension-free working in a sitting position.

In principle, either the seat part 5, 6, 7, 8 and the backrest 9, 16, 17 can preferably be pivoted and locked about a second common horizontal or inclined horizontal axis, which is arranged perpendicular to the first common horizontal or inclined horizontal axis, or the seat part 5, 6, 7, 8 about a third and the backrest 9, 16, 17 about at least a fourth horizontal or inclined horizontal axis and can be locked, which are arranged independently of one another and perpendicular to the second and third independent horizontal or inclined horizontal axes. Due to the additional, freely adjustable and changeable during operation either joint lateral adjustment of the seat part 5, 6, 7, 8 and the backrest 9, 16, 17 or independent lateral adjustment of the seat part 5, 6, 7, 8 and the backrest 9, 16, 17 other positions that are free of fatigue and tension can be taken.

Figure 5:
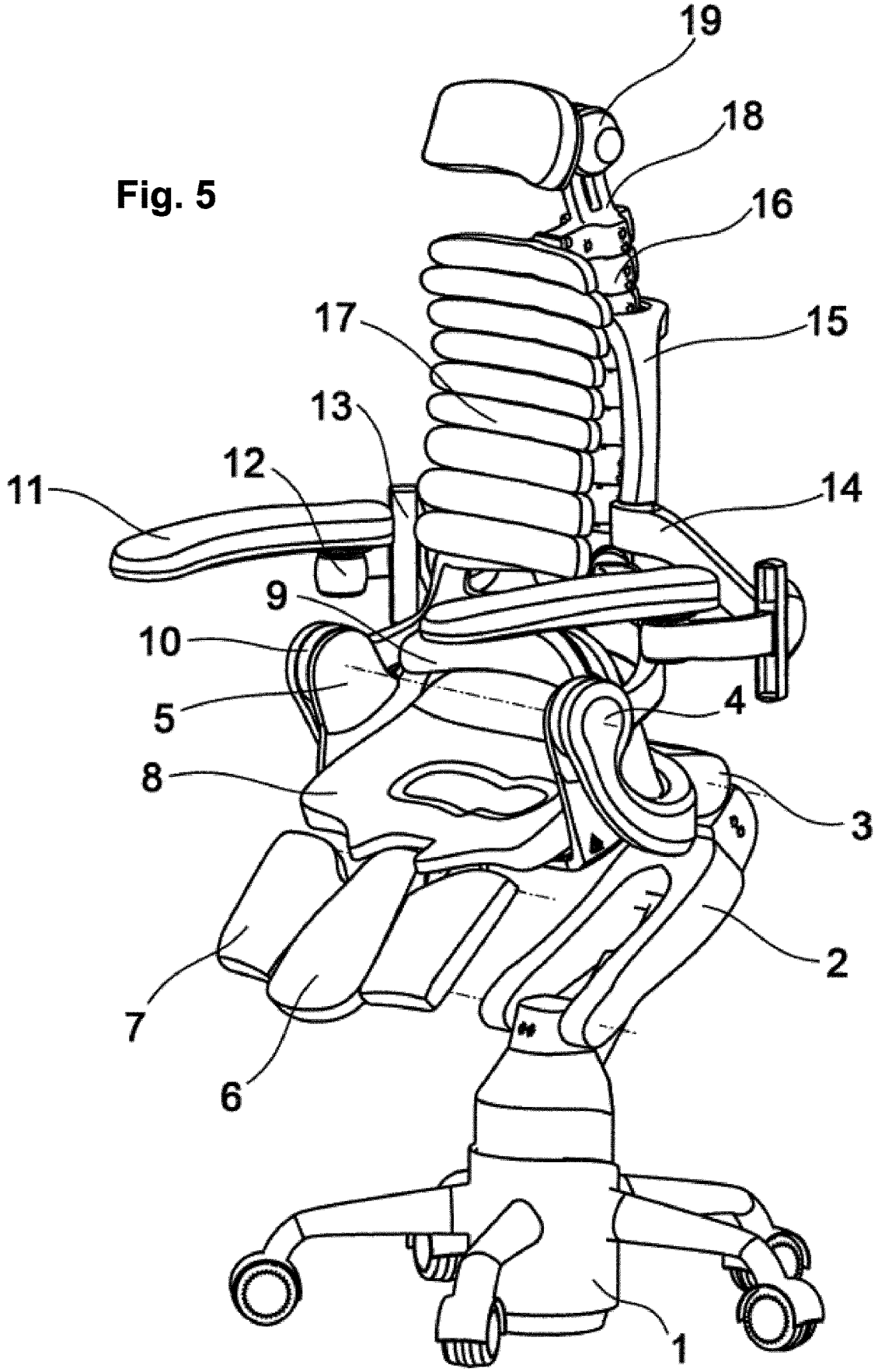
FIG. 5 shows a perspective front view of the embodiment according to FIG. 1 with seat elements of the seat part that can be moved independently of one another.

FIG. 5 shows the embodiment in a second operating position. The seat part 5, 6, 7, 8 can have a seat shell 5 with seat leg recesses 5*a* and/or a seat cushion 8 and/or a saddle curvature 6 and/or leg supports 7, with the seat cushion 8 being able to be arranged in the seat shell 5. Furthermore, the saddle curve 6 and the leg supports 7 can be connected to the seat shell, with the saddle curve 6 and the leg supports 7 being able to be pivoted and locked about a common horizontal or inclined horizontal axis, and with the saddle curve 6 and the leg supports 7 being able to be swiveled and locked independently of one another could be.

This is particularly helpful when the height of the seat part 5, 6, 7, 8 is adjusted relative to the chair base 1 and the user's thighs are therefore at an angle other than a horizontal one. Due to the adjustability of the leg supports 7, there is sufficient support for the thighs at any height. The adjustability of the saddle arch 6, on the other hand, supports the user, for example, when the seat part 5, 6, 7, 8 is tilted forward and prevents the user from slipping forward due to the saddle arch 6 being turned upwards Formation of pressure points on the seat bones or the skin tissue surrounding the user.

The connection of the seat part 5, 6, 7, 8 to the chair base 1 can, as in this embodiment, by means of a base arm 2 connected to the chair base 1 at, at least a first of its ends, a base arm 2 having at least a first of its ends with a further end or a portion of the base arm 2 and a seat arm 4 connected to a first end or portion to a further end or portion of the tilt module 3.

At least one further end of the seat arm 4 can be connected to at least a first end of a back arm 10, wherein the at least first end of the back arm 10 can be connected to at least a first end of the seat shell 5 and a further end or a section of the back arm 10 can be connected to one end of the backrest 9, 16, 17 and a sacral support 9. In particular, a U-shaped design of the base arm 2 and/or the seat arm 4 and/or the back arm 10 gives the structure the greatest possible stability. However, these components can also be designed in the form of a single-sided swingarm to save weight. Depending on the embodiment, these components therefore have, preferably either three or two, ends for connection to other components of the chair according to the invention, with the middle end being formed by a section of the respective component in the case of three ends.

As in this embodiment, the base arm 2 may be pivotable and lockable relative to the chair base 1 about a horizontal or inclined horizontal axis, while the reclining module 3 may be pivotable and lockable relative to the base arm 2 about a horizontal or inclined horizontal axis. The seat arm 4 can be pivotable and lockable relative to the tilting module 2 about a horizontal or tilted horizontal axis, which is arranged perpendicular to the axis between the base arm 2 and the tilting module 3. In addition, the back arm 10 can be pivotable and lockable relative to the seat arm 4 and the seat pan 5 independently of one another, or the seat pan 5 can be pivotable and lockable relative to the seat arm 4 and the back arm 10 independently of one another about a horizontal or inclined horizontal axis. Such an adjustable connection of the base arm 2 to the chair base 1 and the connection of the base arm 2 to the seat arm 4 by means of the inclination module 3 enables the height of the seat part 5, 6, 7, 8 to be adjusted easily. The adjustable connection of the seat arm 4 to the base arm 2 by means of the tilting module 3, which is also described above, also allows the seat part 5, 6, 7, 8 and, if necessary, the backrest 9, 16, 17 to pivot both forwards and backwards as well as laterally. Both adjustment options serve to adopt a position in two spatial directions that is free of fatigue and tension, as already described. A shift in the center of gravity by a person sitting in the chair can therefore cause a direct change in the recline angles of the chair in response to the shift.

Furthermore, as in this embodiment, the seat part 5, 6, 7, 8 with the backrest 9, 16, 17 can be rotatable, height-adjustable and lockable relative to the chair base 2, with the backrest 9, 16, 17 being rotatable relative to the seat part 5, 6, 7, 8 can also be height-adjustable and lockable. Due to the relative adjustability of the seat part 5, 6, 7, 8 with the backrest 9, 16, 17 to the chair base 2, the different sizes of the users can be taken into account and their relative rotation to one another allows the user the greatest possible freedom of movement in the workplace. The relative height adjustability of the backrest 9, 16, 17 to the seat part 5, 6, 7, 8 is also used to adapt to different body proportions of the user.

In addition, as in this embodiment, the backrest 9, 16, 17 can be pivoted and locked about at least one perpendicular and/or inclined vertical axis. This also enables the user, supported by the backrest 9, 16, 17, to turn, in particular his upper body, relative to the seat part 5, 6, 7, 8 or his pelvis.

In principle, the backrest 9, 16, 17 can have individual vertebral modules 16 connected to one another and preferably back slats 17 connected to these. This enables particularly effective support for the individual vertebral bodies of the spine and the back muscles of the user.

Also, as in this embodiment, the chair can have armrests 11, 12, 13, 14, 15 that are spatially adjustable. This allows easy adjustment of the armrests 11, 12, 13, 14, 15 to the body proportions of the user and a preferred arm position.

The spatial adjustability of the armrests 11, 12, 13, 14, 15 relative to the seat part 5, 6, 7, 8 can, as in this embodiment, be independently height-adjustable around two vertical or inclined vertical axes and swiveling and lockable around a horizontal or inclined horizontal axis.

According to the present invention, spatially adjustable, which can also be referred to as displacement, means in particular that e.g the backrest or the headboard in several spatial directions is preferably simultaneously adjustable, or when adjusting/relocating (seen from above the chair) can describe an ellipse or a circular path.

A spatial adjustability should in particular describe a complex and/or dynamic mobility/adjustability of the component. This enables the component (backrest, headboard, . . . ) to follow any upper body movement of a person sitting on the chair (lateral tilting, bending forwards and backwards, circular movement of the upper body above the lumbar vertebrae or above the hips, twisting of the torso versus hip alignment). This can be brought about, for example, as a function of pressure exerted on the component (e.g. when leaning forwards and backwards or when turning to one side). The backrest or a seat for a backrest or for backrest elements that form a backrest can have a plurality of vertebral elements which are connected to one another in an articulated manner. As a result, complex mobility of the receptacle or the backrest can be provided. The articulated connection can in particular be a ball and socket joint connection. According to the invention, however, the configuration of the articulated connection should not be important. However, it can be essential that the joint enables the vertebral elements to be adjustable in several spatial directions relative to one another (simultaneously).

In principle, the armrests 11, 12, 13, 14, 15 can have a common main arm 15 and/or an armrest 11 and/or a holder 12 and/or a height adjustment 13 and/or a rotary arm 14, the armrest 11 being on one first end of the bracket 12 is mounted. In this case, the holder 12 can be mounted with a second end on the height adjustment 13, the height adjustment 13 being mounted on a first end of the rotary arm 14. In addition, a second end of the pivot arm 14 may be supported to a first or second end of the main arm 15 with a portion of the main arm 15 being connected to a vertebral module 16.

Additionally, as in this embodiment, the armrest 11 may be pivotable and lockable relative to the bracket 12 about a vertical or inclined vertical axis, while the bracket 12 may be slidable and lockable along a vertical or inclined vertical guide of the height adjuster 13. The height adjuster 13 can be pivotable and lockable relative to the rotary arm 14 about a horizontal or inclined horizontal axis, with a second end of the rotary arm 14 being pivotable and lockable relative to the main arm 15 about a vertical or inclined vertical axis.

It can expediently be provided that the chair has a headrest 18, 19 which is spatially adjustable. This also allows an adjustment to the body proportions of the user, with the headrest 18, 19 also being able to be adjusted to a particular working position of the head.

As in this embodiment, the headrest 18, 19 can have a first end connected to a further end of the backrest 9, 16, 17 and/or a head holder 19 connected to a further end of the final vertebra 18. Furthermore, the head mount 19 can be displaced along a vertical or inclined vertical guide of the final vertebra 18 and can be pivoted and locked about a horizontal and/or inclined horizontal axis perpendicular to the guide. It can thus be ensured that the headgear 19 supports the optimum position on the back of the user's head and has a suitable inclination for this.

Figure 6:
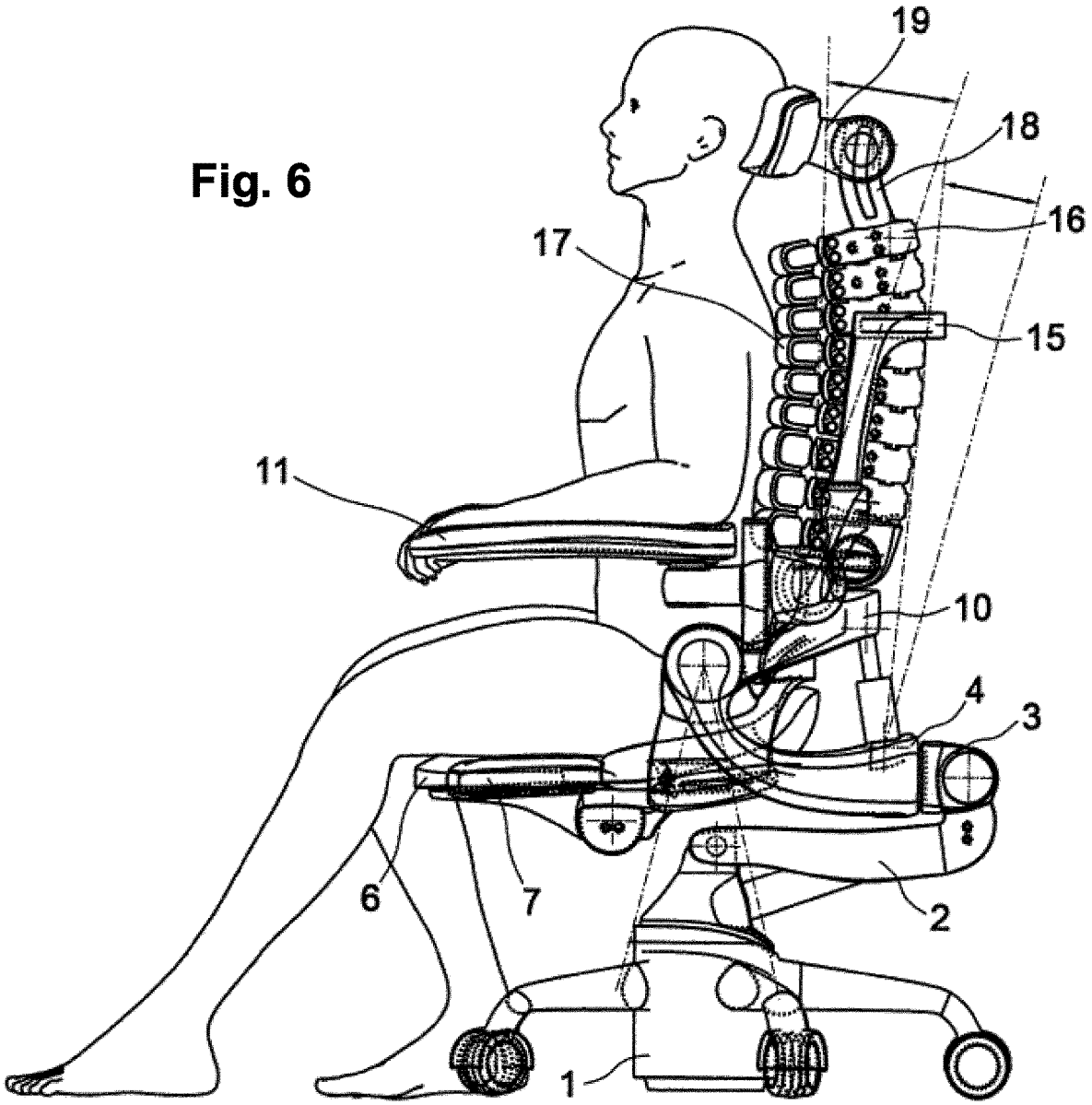
FIG. 6 is a side view of the embodiment of FIG. 1.

FIG. 6 shows the embodiment in a side view, the adjustability of the backrest 9, 16, 17 forwards and/or backwards being indicated either together with the seat part 5, 6, 7, 8 or independently by means of the double arrows. The support of the thighs and/or the arms and/or the back and/or the head of the user by the leg supports 7, the arm supports 11, the back slats 17 arranged on the vertebral modules 16 and the head holder 19 can be clearly seen.

In order to enable a particularly flexible and continuous change in the body position of the user, the seat part 5, 6, 7, 8 and/or the backrest 9, 16, 17 can be mounted so that they can move freely, as in this embodiment. As a result, it is not necessary for the user to constantly readjust and fix the various components of the chair to one another when the posture changes.

For particularly free movement at the workplace, the chair base 1 can be mounted on rollers, as in this embodiment. The chair base 1 can preferably be mounted on five rollers in order to prevent the chair from tipping over during a displacement process.

In order to enable simultaneous pivoting of the base arm 2 and the tilting module 3, the base arm 2 can also be connected to the tilting module 3 by means of a gear chain 2*a*. The transmission chain 2*a* runs around the horizontal or inclined horizontal axes between the chair base 1 and the base arm 2 and/or between the base arm 2 and the tilting module 3. The base arm 2 and the tilting module 3 can also be pivoted independently of one another, e.g. by means of a freewheel function integrated into the respective axis.

Figure 7:
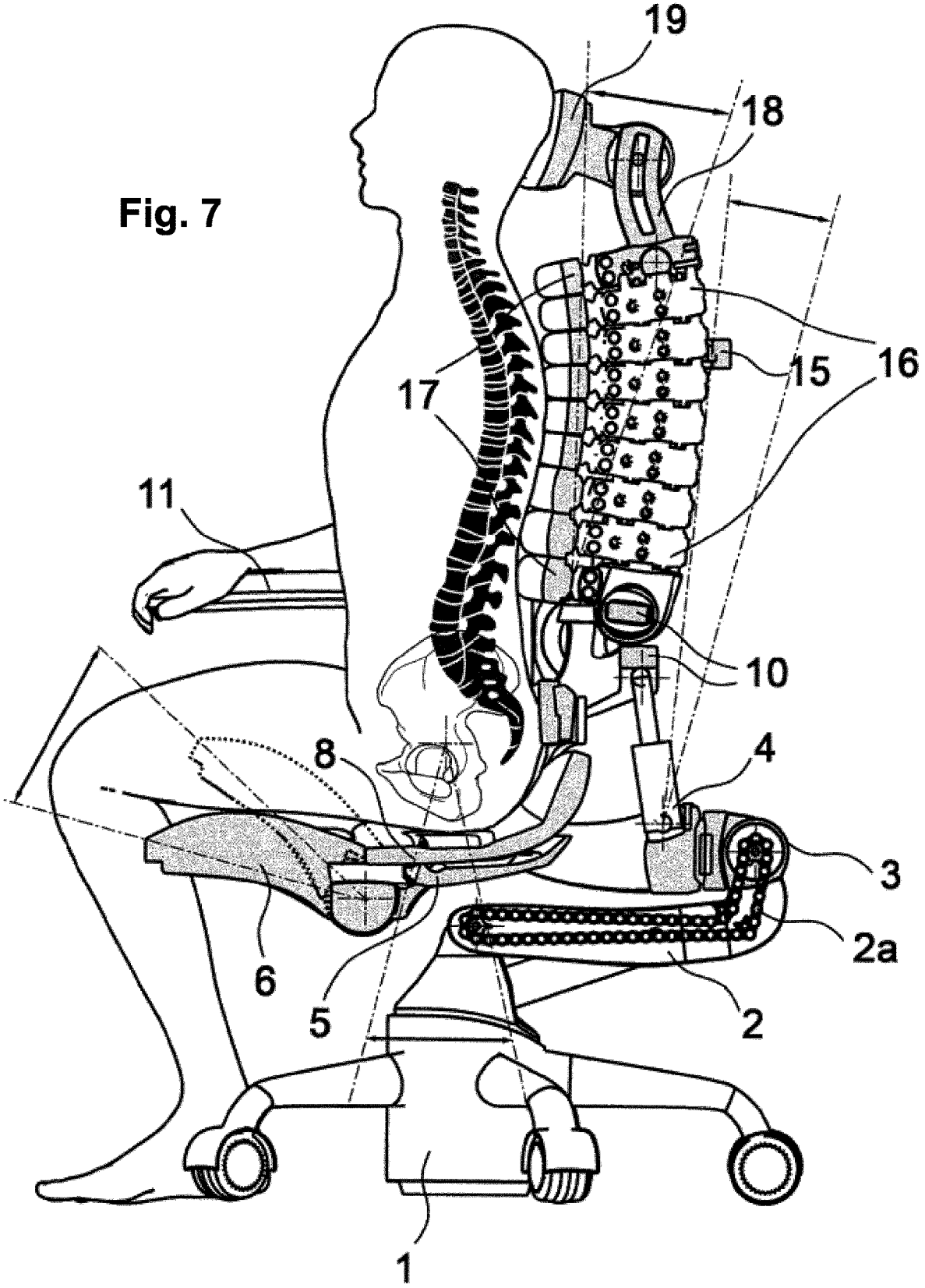
FIG. 7 is a side sectional view of the embodiment of FIG. 1
Figure 8:
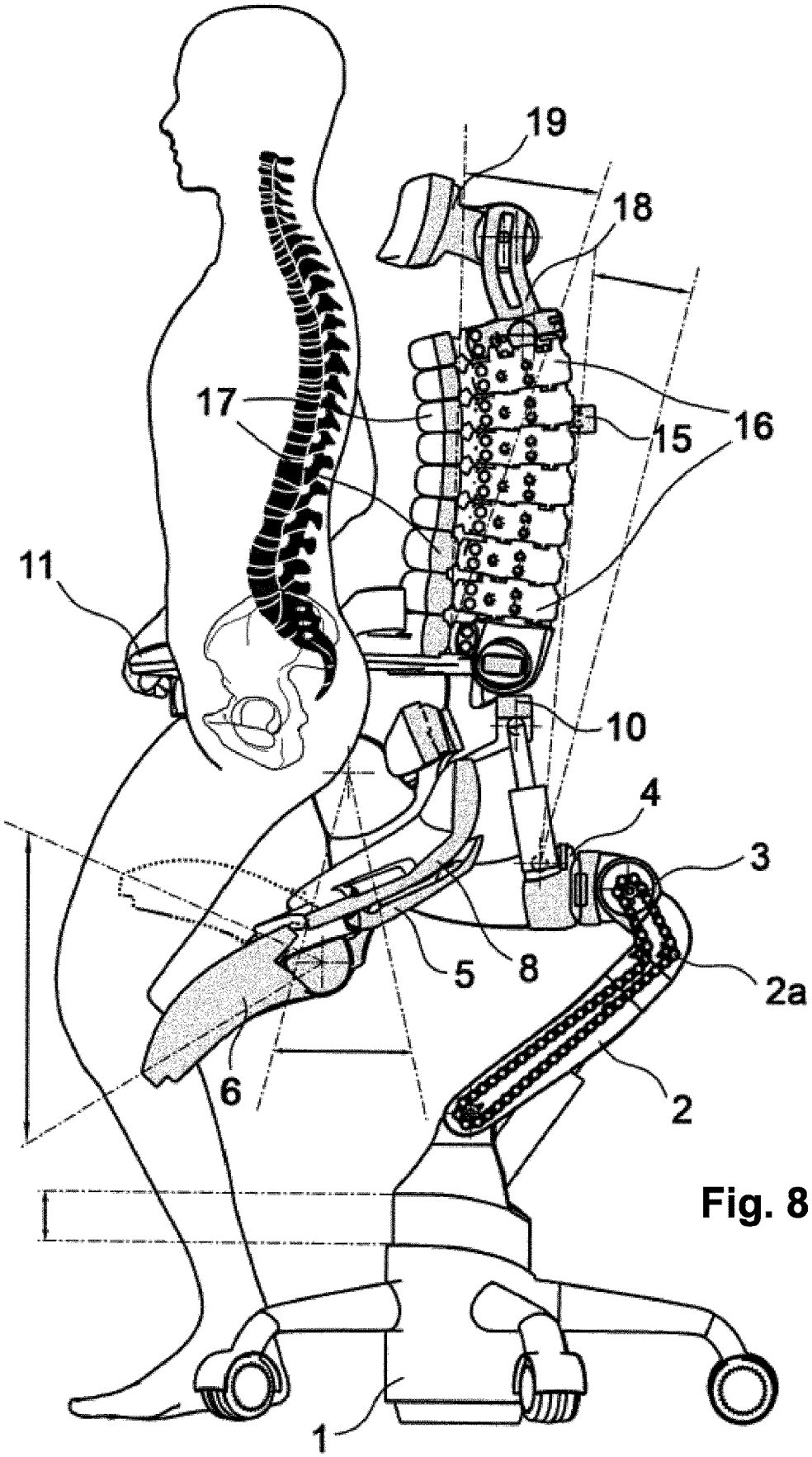
FIG. 8 shows another side sectional view of the embodiment according to FIG. 1.

The FIGS. 7 and 8 show the embodiment with the user in a side sectional view in a first and second operating position, showing the gear chain 2*a* running around the axes between the chair base 1 and the base arm 2 and the base arm 2 and the tilting module 3. FIG. 7 also shows an upwardly pivoted saddle curvature 6 before the seat shell 5 with the seat cushion 8 is pivoted downwards.

FIG. 8, on the other hand, shows the seat part 5, 6, 7, 8 with the backrest 9, 16, 17 height-adjusted upwards and the seat shell 5 pivoted downwards with the seat cushion 8, with the saddle curvature 6 pivoted upwards preventing the user from slipping forward prevented.

To ensure easy and dampened adjustability, as in this embodiment, the chair base 1 with the base arm 2 and/or the seat arm 4 with the back arm 10 can also each be connected by means of a damping mechanism, such as a damping mechanism can be connected to a gas spring. In this way, in particular, the height adjustment of the seat part 5, 6, 7, 8 in relation to the chair base 1 can be supported easily. When the backrest 9, 16, 17 and the seat part 5, 6, 7, 8 are mounted so that they can move freely in relation to one another, the back of the user is supported at all times and in every position.

A particularly preferred adaptation of the backrest 9, 16, 17 to the proportions of the user and his posture, in particular the upper body, is supported by the fact that the vertebral modules 16 can be connected to one another in an articulated and/or spring-loaded manner and/or in an adjustable manner. This makes it possible, in particular, for the user to be able to tilt his upper body forwards, backwards or to the side and for the vertebral modules 16 with the associated back lamellae 17 to be able to follow this movement. The joints between the vertebral modules 16 are designed in such a way that they form horizontal and/or inclined horizontal axes and vertical and/or inclined vertical axes about which the vertebral modules 16 and the associated back lamellae 17 can be pivoted relative to one another in two spatial directions. Preferably, the modules are connected by ball joints. The back slats 17 can be connected to the vertebral modules 16, for example by means of a damping mechanism such. B. springs or elastic materials.

The seating comfort can be increased in that the seat cushion 8 and the back slats 17 are made of elastic materials, such as rubber or foam, in particular a so-called memory foam.

The seat cushion 8 can also have a section which overlaps with the ischial depression 5*a* and whose material properties are adapted to the ischial depression 5*a*. The section z. B. compared to the rest of the seat of the seat cushion 8 have a higher or lower strength.

Figure 9:
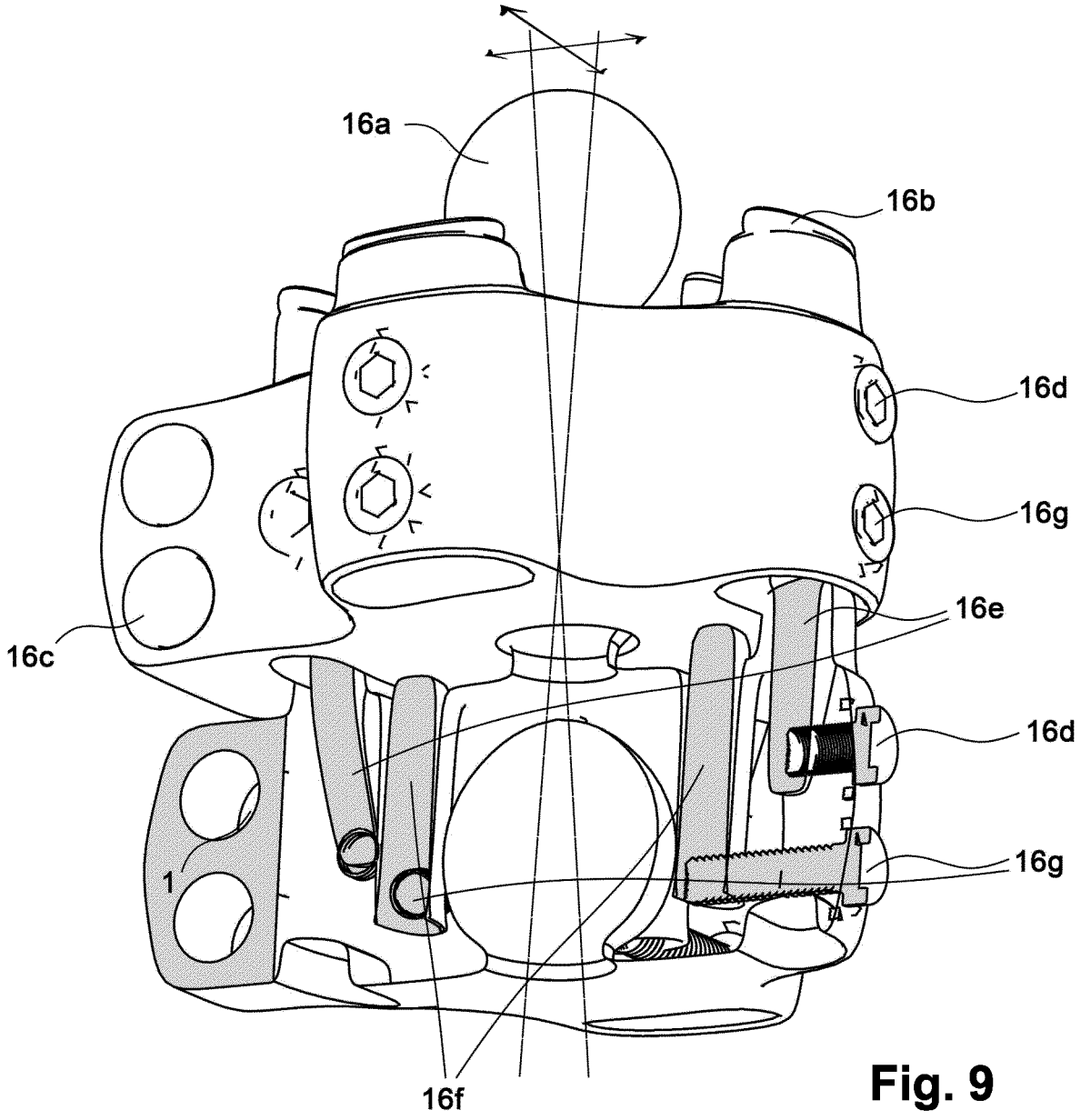
FIG. 9 shows a representation of two operatively connected vertebral elements.

FIG. 9 shows a module 16 according to the invention, which is operationally connected to a further module 16. The lower module 16 is shown in a cross-sectional view.

A module 16 can have one or more receptacles 16*c* for backrest elements, which can be designed as slats 17.

Each module may have a ball joint 16*a* and/or a corresponding socket on a side opposite the ball joint.

In the operational state of connection between two modules, a joint ball 16*a* is mounted in a corresponding joint socket of the module 16 above.

This enables an angle change between two modules connected in this way. To limit the angle of inclination between two modules, adjusting means can be provided, for example in the form of spacer pins 16*f*, which can be advanced from one module 16 in the direction of the next module 16 connected thereto. As a result, a distance between the adjusting means and the next module can be adjustable, as a result of which the angle of inclination can be limited as a function of the distance.

To adjust the adjusting means, an adjusting means can be provided, for example in the form of a spacer screw 16*g*, via which the adjusting means can be moved in and out of the module 16. The further the adjusting means is extended out of the module 16, the smaller the angle by which the module 16 can be tilted relative to a further module connected to the first module on the side of the adjusting means.

In particular, to stabilize the position of the individual modules 16 relative to one another, an elastic connection can be provided between two adjacent modules in each case. This can also be referred to as an elastic part.

The elastic connection can in particular be provided in the form of a tensioning material 16*e*. The clamping material 16*e* is particularly preferably assigned to a module 16 at one end and fixed to it.

The fixation 16*d* can take place, for example, via a clamping screw, by means of which a tension of the clamping material 16*e* can be adjustable and/or readjustable.

At an opposite end, the tensioning material 16*e* can have a connection or a connection means 16*b* to an adjacent vertebral module, in particular in the stretching direction of the tensioning material 16*e*.

In particular, this further, distal end of the tensioning material 16*e* can be designed with a tensioning head 16*b* or some other connecting or latching means, which can be connected to an adjacent vertebral module 16.

To connect the connecting or latching means of the clamping material 16*e* to the next vertebral module 16, this next vertebral module 16 can have an opening facing the clamping material 16*e* of the first module 16 or a connecting part, in or with which the connecting or latching means can be connected. Such a connection via the clamping material 16*e* according to the invention can form an elastic connection between a first and a second vertebral module, which are adjacent to one another.

The clamping head 16*b* can be provided at a distance from its vertebral module 16 and/or protrude from it. An elastic covering material can be provided in a transition region between the clamping head 16*b* and a base body of the vertebral module 16, in which the clamping material 16*e* can be fixed. The liner material may be provided in a bridging manner between the vertebral module and the distal end of the tensioning material so that the tensioning head may be movably mounted with respect to the main body of the module, although it may nonetheless be fixed thereto.

Particularly preferably, the clamping head 16*b*, or the connecting or latching means, can be latched with the facing opening or the connecting part of the next vertebral module 16.

A number of connections are particularly preferably provided between 2 vertebral modules 16 via corresponding tensioning materials 16*e*. These are expediently provided, preferably at least on 4 sides in one plane, opposite the joint ball 16*a*. As a result, the position of a vertebral module 16 relative to another vertebral module 16 can be stabilized in a basic position, in particular by a uniform tension of the tensioning materials among one another, in which the tension forces of the individual tensioning materials 16*e* can cancel out/neutralize each other.

In the basic position, two adjacent vertebral modules are preferably aligned plane-parallel to one another. Several vertebral modules can together form a backrest on which backrest elements can form a support surface for the back of a person sitting on the chair.

The above statements on the tensioning material and its interactions with other devices of the vertebral module/the vertebral modules apply equally to the generally described elastic connection or elastic part.

The clamping material can also be described as an elastic band.

Figure 10:
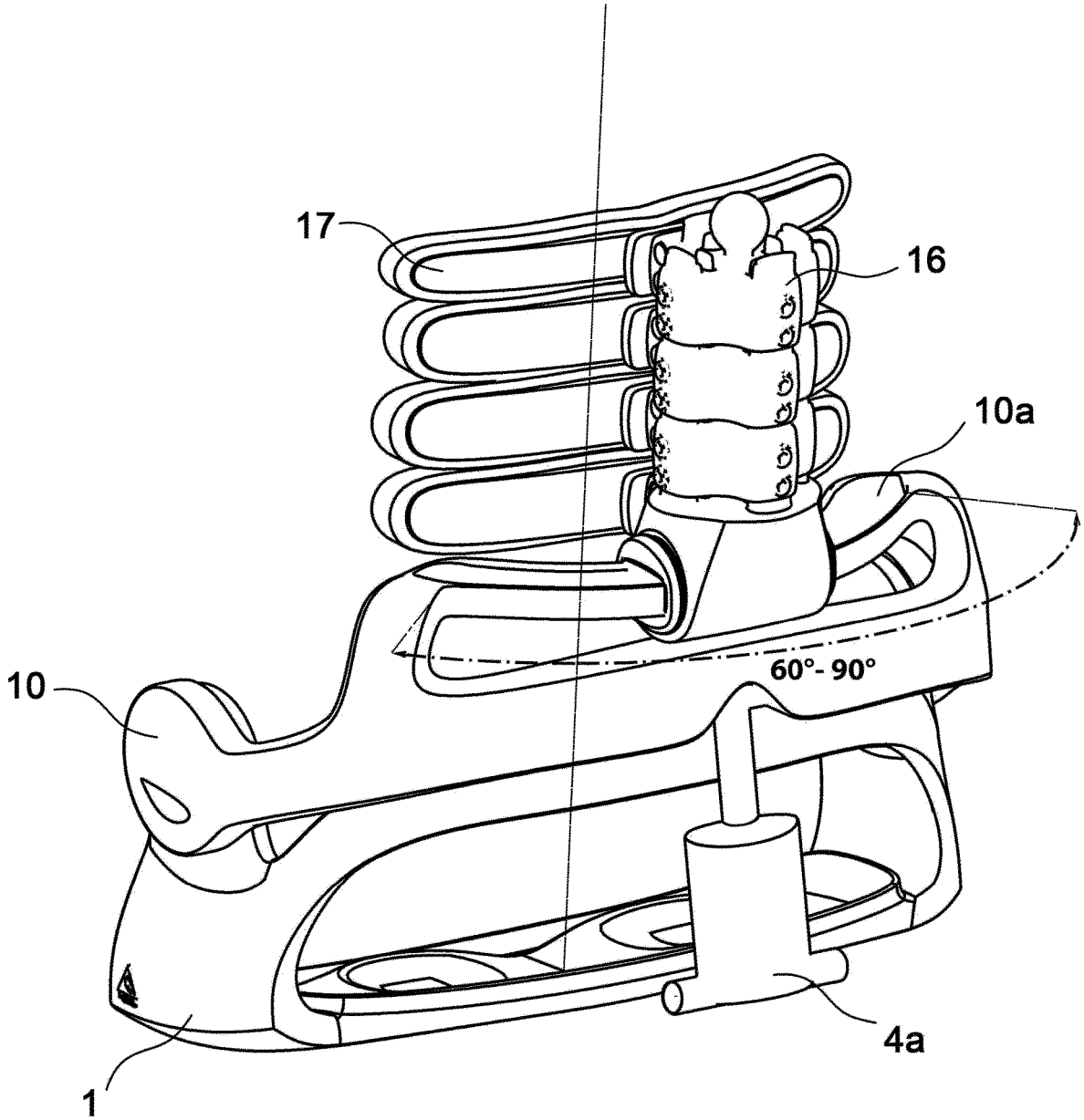
FIG. 10 shows a connection of the arrangement of the vertebral element and the seating area.

FIG. 10 shows a rear view of a section of the chair according to the invention with the chair base 1, which can be arranged in a freely swinging manner on a receptacle, in particular on the back arm 10 of the chair. The back arm 10/the receptacle can have a slide guide 10*a* on which the backrest, in particular the modules 16, is/are mounted so that it can move laterally, preferably via a connecting element. The backrest can thus be displaced along a trajectory in a horizontal plane via the carriage guide 10*a*. Such a plane can also have a curvature The backrest preferably moves along a circular arc section in the plane. The type of movement of the backrest can be largely determined by the shape of the carriage guide 10*a*. The carriage guide is preferably curved in a horizontal plane in such a way that the center of the circle, which belongs to the circular arc section of the carriage 10*a*, is located inside, preferably in the stomach area, of a person sitting on the chair or in front of him. The center of the circle, which belongs to the circular arc section of the carriage guide 10*a*, can thus lie in front of the backrest, preferably in the same plane as the carriage guide 10*a*.

In particular for adjusting an inclination of the backrest, an adjustment means can be provided, for example in the form of a gas spring 4*a*, which can be connected to the back arm 10. The adjustment means 4*a* may in turn be attached to the seat arm 4 of the chair 12, or to another area of the base of the chair.

A further aspect of the present invention is a seat for a backrest of a chair, which has a plurality of vertebral elements 16 which are arranged one above the other and which are connected to one another in an articulated manner.

It is preferably provided that the articulated connection between the vertebral elements has a ball and socket joint 16*a*, 16*h*.

Provision is preferably made for each vertebral element 16 to have at least one ball 16*a* and at least one socket 16*h*.

It is expediently provided that the ball 16*a* and the socket 16*h* of a vertebral element 16 are provided on different sides of the vertebral element 16, preferably opposite sides, of the vertebral element (16) as individual connecting means of the vertebral element 16 to two adjacent vertebral elements.

Provision is preferably made for the vertebral elements 16 to be connected via elastic tensioning elements 16*e*, which preferably stabilize the articulated connections between the vertebral elements 16 in terms of direction so that the overall alignment of the receptacle is vertical.

Provision is preferably made for the tensioning elements 16*e* to connect adjacent vertebral elements 16 to one another and/or to stabilize them relative to one another.

Preferably the tensioning elements 16*e* are provided at least on one of the connected vertebral elements 16 with a tensioning means, in particular a tensioning screw or a tensioning lever, via which a tension or tensile force of the tensioning elements between the vertebral elements can be adjusted.

Provision is preferably made for the vertebral elements 16 to have latching elements 16*b* and latching receptacles 16*i* in addition to the articulated connection, by means of which adjacent vertebral elements can be movably guided and/or latched to one another.

Provision is preferably made for the tensioning elements 16*e* of a vertebral element to engage in the latching receptacles of an adjacent vertebral element in a connecting manner.

It is preferably provided that on at least one, preferably on (each of) the vertebral element(s) 16 at least one, preferably 2 or 3, actuator(s) 16*f* is (are) provided, which is/are, in the operational connection state of the vertebral elements, an adjacent vertebral element (with an adjustable distance or without a distance, i.e. adjustable) is/are adaptively positionable, as a result of which an inclined movement of the articulated connection between the vertebral element and the adjacent vertebral elements can be limited in an adjustable manner. In principle, vertebral elements can be tilted in relation to one another in a number of spatial directions (e.g. front, rear, right, left, a combination of the aforementioned). The inclination between the vertebral elements can be at least in a plane, which can run parallel to two surfaces of the adjacent vertebral elements (in a (vertical) initial position/initial orientation of the vertebral elements), with any number of degrees of angle to the plane and/or in any direction of inclination to the plane take place. It is also possible to change the angle of the vertebrae and tilt the associated backrest, for example, diagonally to the right in front or diagonally to the left behind with any number of degrees of alignment of the inclination in the plane. The vertebral elements can also be (limitedly) rotatable relative to one another, in particular to the extent that the tensioning materials 16*e* between the vertebral elements permit this.

As a result, a backrest fastened to the vertebral elements can freely follow any movement of the upper body (tilting sideways, backwards, forwards, obliquely forwards, obliquely backwards) and/or even twisting.

Preferably, the seat cushion (5) and/or the sacrum support (9) can be variably mounted and/or fixed relative to the seat shell 5, ie its position can be adjusted.

REFERENCE SIGN LIST

1 chair base
2 base arm
2*a* transmission chain
3 tilt module
4 seat arm
5 seat shell
5*a* ischial depression
6 saddle curvature
7 leg rest
8 seat cushions
9 sacrum support
10 back arm
10*a* slide guide
11 armrest
12 bracket
13 Height Adjustment
14 rotating arm
15 main arm
16 vertebral modules
16*a* joint ball
16*b* lanyard/clamping head
16*c* mount for backrest elements/slats
16*d* fixation for clamping material
16*e* clamping material
17 back slats
18 final vertebrae
19 head mount

The invention claimed is:

1. A chair comprising a chair base, a seat part connected thereto, a backrest connected thereto, wherein the seat part is freely pivotable about at least one horizontal or inclined horizontal axis, wherein the seat part has a seat surface for a buttocks region and at least three independently adjustable seat elements for a thigh region of a person sitting on the chair, the operating positions of which are individually adjustable, and that the horizontal pivot axis of the seat part is arranged approximately centrally above the seat surface of the seat part, wherein a joint is arranged on the chair base and connects the seat part to the chair base in a freely swinging manner and whereby the horizontal pivot axis is approximately coaxial with a hip joint axis of the person.

2. The chair according to claim 1, wherein the backrest is spatially adjustable, wherein a receptacle of the backrest, which extends at least in regions along the backrest, has a plurality of swivel elements which are arranged one above the other and are connected to one another in an articulated manner.

3. The chair according to claim 1, wherein either the seat part and the backrest are pivotable and lockable about a second common horizontal or inclined horizontal axis which is arranged perpendicular to the first common horizontal or inclined horizontal axis, or the seat part about a third and the backrest about at least a fourth horizontal or inclined horizontal axis which are independent of each other and perpendicular to the second and third horizontal or inclined horizontal axes.

4. A chair comprising a chair base, a seat part connected thereto, a backrest connected thereto, wherein the seat part is pivotable about at least one horizontal or inclined horizontal axis, wherein the seat part has a seat surface for a buttocks region and at least three independently adjustable seat elements for a thigh region of a person sitting on the chair, the operating positions of which are individually adjustable, and that the horizontal pivot axis of the seat part is arranged approximately centrally above the seat surface of the seat part, whereby the horizontal pivot axis is approximately coaxial with a hip joint axis of the person, wherein the seat part has a seat shell with seat leg recesses, a seat cushion, a saddle curvature and leg supports, the seat cushion being arranged in the seat shell and/or in that the saddle curvature and the leg supports are connected to the seat shell and/or that the saddle curvature and the leg supports are pivotable and lockable about a common horizontal or inclined horizontal axis, and/or the saddle curvature and the leg supports are pivotable and lockable independently of each other.

5. The chair according to claim 4, wherein the seat part is connected to the chair base by a base arm connected to the chair base at at least a first end thereof, a tilt module connected to at least a first end thereof to a further end or a portion of the base arm, and a seat arm connected to a first end or a portion to a further end or a portion of the tilt module, wherein at least one further end of the seat arm is connected to at least one first end of a back arm and wherein the at least first end of the back arm is connected to at least one first end of the seat shell, and wherein a further end or a section of the back arm is connected to an end of the backrest and a sacral support.

6. The chair according to claim 5, wherein the base arm can be pivoted and locked relative to the chair base about a horizontal or inclined horizontal axis and/or in that the inclination module can be pivoted and locked relative to the base arm about a horizontal or inclined horizontal axis and/or that the seat arm is pivotable and lockable relative to the tilt module about a horizontal or inclined horizontal axis arranged perpendicular to the axis between the base arm and the tilt module, and/or that the back arm relative to the seat arm and the seat shell independently of each other or the seat shell relative to the seat arm and the back arm independently of each other are pivotable and lockable about a horizontal or inclined horizontal axis.

7. The chair according to claim 1, wherein the chair has a headrest which is spatially adjustable.

8. A chair comprising a chair base, a seat part connected thereto, a backrest connected thereto, wherein the seat part is pivotable about at least one horizontal or inclined horizontal axis, wherein the seat part has a seat surface for a buttocks region and at least three independently adjustable seat elements for a thigh region of a person sitting on the chair, the operating positions of which are individually adjustable, and that the horizontal pivot axis of the seat part is arranged approximately centrally above the seat surface of the seat part, whereby the horizontal pivot axis is approximately coaxial with a hip joint axis of the person, wherein the headrest comprises an end vertebra connected with a first end to a further end of the backrest and a head support connected to a further end of the end vertebra, and that the head support is displaceable along a vertical or inclined vertical guide of the end vertebra and is pivotable and lockable about a horizontal or inclined horizontal axis perpendicular to the guide.

* * * * *